United States Patent [19]

Mosz

[11] 4,144,897

[45] Mar. 20, 1979

[54] HAIR BLEACHING COMPACT

[76] Inventor: Karoly Z. Mosz, 11638 Barrington Ct., Los Angeles, Calif. 90049

[21] Appl. No.: 787,298

[22] Filed: Apr. 13, 1977

[51] Int. Cl.[2] ..... A45D 1/00

[52] U.S. Cl. ..... 132/9

[58] Field of Search ..... 132/9, 42 R, 43 A, 40, 132/39

[56] References Cited

U.S. PATENT DOCUMENTS

| | | | |
|---|---|---|---|
| 1,550,930 | 8/1925 | Sullivan | 132/9 |
| 3,452,759 | 7/1969 | Sarinelli | 132/9 |
| 3,692,032 | 9/1972 | Regas | 132/9 |
| 3,871,388 | 3/1975 | Leoci | 132/9 |
| 3,941,613 | 3/1976 | Nicoletti | 132/9 |

*Primary Examiner*—G.E. McNeill

*Attorney, Agent, or Firm*—Thomas A. Fournie

[57] ABSTRACT

Hinged case structure which may be selectively opened and closed defines a cavity of selected depth, length and width for holding hair with bleach applied thereto. Seal structure is associated with the edges of the case to prevent leakage of bleach from the closed case and latch structure is provided for selectively latching the case closed. The case structure defines a hair receiving end having a curvature conforming to the scalp to permit bleaching of hair strands down to their roots. Also, the case structure is shaped to lay against the side of a person's head with one hair bleaching compact resting against another.

1 Claim, 5 Drawing Figures

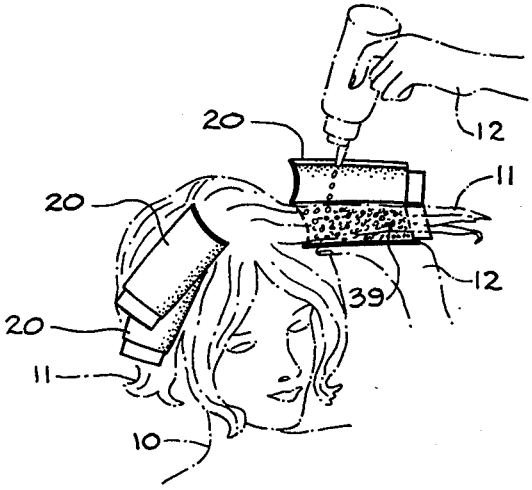
FIG. 1.
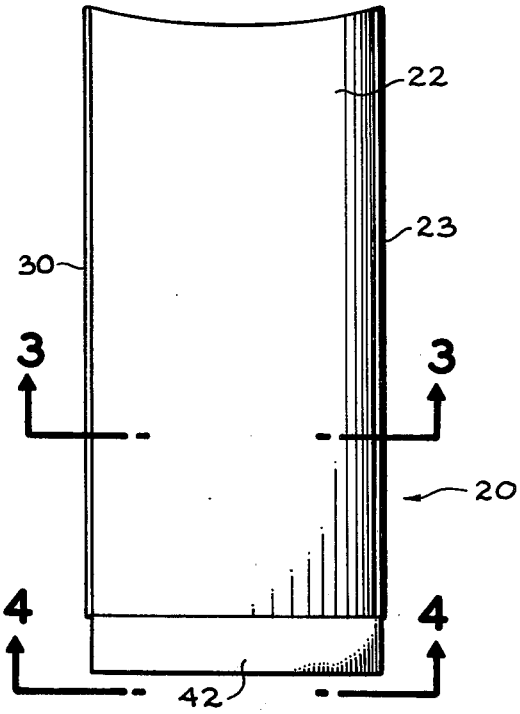
FIG. 2.
FIG. 3.
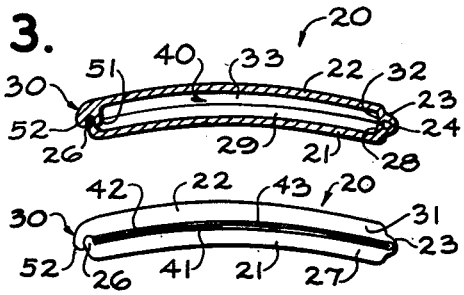
FIG. 4.
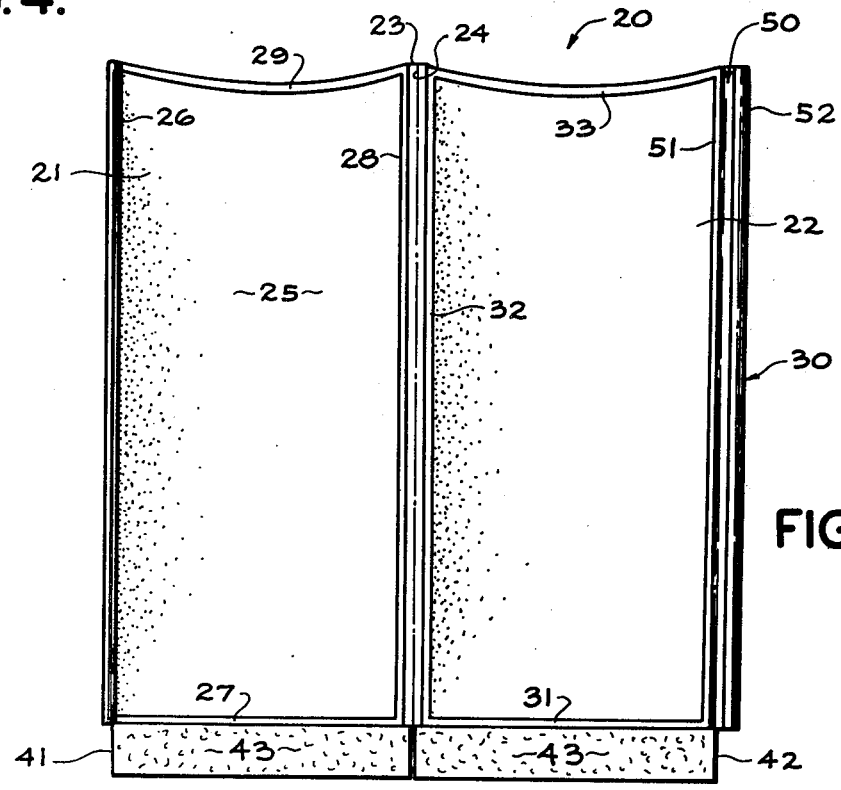
FIG. 5.

HAIR BLEACHING COMPACT

BACKGROUND OF THE INVENTION

The present invention relates to hairdressing and more particularly to apparatus suitable for use by hairdressers and coiffeurs in bleaching hair.

Women commonly go to hairdressers for the purpose of having the color of all or selected portions of their hair changed. If the women's hair is dark and she wishes its color to be changed to a lighter color, commonly the portion of the hair to be dyed is first bleached. Presently, the hair bleaching compounds used are usually applied in the form of a fluid paste.

Further, once the woman's hair color is changed, it is generally necessary for her to periodically return to the hairdresser to have newly grown hair adjacent the hair roots bleached and dyed. In such bleaching of the newly grown hair, it is important that old hair is not rebleached since such rebleaching could damage the hair.

SUMMARY OF THE INVENTION

Accordingly, it is an object of the present invention to provide improved apparatus in the form of a hair bleaching compact suitable for use by hairdressers or coiffeurs for applying bleach to selected strands of a person's hair, selected portions of individual hair strands, or entire areas of a person's head of hair.

It is further an object of the present invention to provide a hair bleaching compact as set forth particularly suited for use in applying bleach to newly grown hair adjacent the hair roots so as to permit bleaching of same without rebleaching previously bleached portions of a person's head of hair.

It is additionally an object of the present invention to provide a hair bleaching compact as set forth characterized by being easy and safe to use, relatively inexpensive and easy to manufacture, and of space efficient construction so that a number of such devices can be placed on a person's head in relatively close proximity.

It is also an object of the present invention to provide a hair bleaching compact as set forth characterized by defining a cavity substantially sealed against bleach leakage for holding hair with bleach applied thereto during the bleaching process and which is contoured to conform to the shape of a person's head.

In accomplishing these and other objects, there is provided a hair bleaching compact formed by hinged case structure which may be selectively opened for the placement of hair therein. The case structure when closed defines a cavity of selected depth, length and width for holding hair with bleach applied thereto. Seal structure is associated with the edges of the case to prevent leakage of bleach from the closed case and latch structure is provided for selectively latching the case closed. The case structure defines a hair receiving end having a curvature conforming to the scalp to permit bleaching of hair strands down to their roots. Also, the case structure is shaped to lay against the side of a person's head with one hair bleaching compact resting against another.

Additional objects of the present invention reside in the specific construction of the hair bleaching compact hereinafter described in conjunction with the several drawing figures.

BRIEF DESCRIPTION OF THE DRAWINGS

FIG. 1 is a view of a woman's head showing two hair bleaching compacts according to the present invention applied to the woman's hair and a third such compact in the process of being applied thereto.

FIG. 2 is a longitudinal plan view of one of the hair bleaching compacts of FIG. 1 shown closed.

FIG. 3 is a cross-sectional view of the hair bleaching compact of FIG. 2 taken along the line 3—3.

FIG. 4 is an end view of the hair bleaching compact of FIG. 2 taken along the line 4—4.

FIG. 5 is a longitudinal plan view of the hair bleaching compact of FIG. 2 shown opened.

DETAILED DESCRIPTION OF THE PREFERRED EMBODIMENT

Referring to the drawings in more detail, there is shown in FIG. 1 a woman 10 in the process of having her hair 11 bleached by the hairdresser 12. The hands only of the hairdresser 12 are shown.

The woman's hair 11 is being bleached by use of hair bleaching compacts 20. Two compacts 20 are illustrated secured on the hair 11 on the right side of the lady's head while a third compact 20 is illustrated open being placed by the hairdresser 12 on the left side of her head.

Referring to FIGS. 2–5, the details of the construction of one of the compacts 20 is there shown. The compact 20 is preferably made as an integral unit of a pliable resilient plastic material, for example, by an injection type molding process.

The compact 20 is formed by case structure made up of two mating portions or halves 21 and 22, which are hinged together along their length by a flexible hinge element 23. The hinge 23 bends along the line 24. The line of bend 24 is identified by a broken line in FIG. 5 and its location is also indicated in FIG. 3.

The case half 21 defines a substantially rectangularly shaped well 25 having edge structure 26–29 of substantially uniform height. The well 25 provides, as shown in FIG. 1, a hair receiving receptacle in which the hair strands 11 may be placed while bleach 39 is being applied thereto. Thereby, the well 25 tends to collect bleach 39 applied to the hair 11 so as to prevent same from falling on the woman 10.

It is noted that the bleach 39 generally used is formed as a fluid paste by mixing bleaching powder with liquid peroxide.

The case half 22 defines the cover or lid for the well 25 and has edge structure 30–33. The edges 30–33 mate, respectively, as hereinafter described, with the edges 26–29 to form the side walls of a closed hair receiving cavity 40.

Referring to FIGS. 3–5, the mating portions of the edge structure 29 and 33, 27 and 31, and 28 and 32 are flat surfaces which when pressed together form a seal effective to prevent bleach leaking from the cavity 25. Further, overlapping flaps 41 and 42 are formed as part of the compact case structure to extent from the edges 27 and 31, respectively. The mating surfaces of the flaps 41 and 42 have conventional type self-gripping surfaces 43 formed thereon which tightly adhere to each other when pressed together, as shown in FIG. 4

The seal or bond formed by the self-gripping surfaces 43 serves several functions. As shown in FIG. 1, the end of the compact 20 carrying the flaps 41 and 42 extends downwardly when the compact 20 is secured to a person's hair. Accordingly, the seal formed by the gripping surfaces 43 provide an additional barrier which cooperates with the mating portions of the edges 27 and 31 to prevent bleach leakage onto the person whose hair is being bleached. Further, the self-gripping surfaces 43 aid to retain the compact 20 in a latched close position. Upon opening the compact 20, the frictionally mating surfaces 43 may be pulled apart.

In FIGS. 3 and 4, the compact 20 is illustrated latched closed by the seal structure formed by the mating edge structure 26 and 30. The edge 26 is formed as a longitudinal extending rounded lip, while edge 30 defines a longitudinal groove 50 dimensioned to receive the rounded lip 26. The lip 26 and groove 50 frictionally mate, the resilient pliable material by which the groove 50 is defined springing open slightly to permit entry of the lip 26 therein. To open the compact 20, the outer edge 52 of the edge structure 30 may be pulled upon to pull the lip 26 and groove 50 apart. It is noted that the inner edge 51 of the edge structure 30 forms in cooperation with the lip 26 a barrier to leakage of bleach 39 from the side of the cavity 40.

In this regard, it is noted that the hinge 23, which defines a surface extending the length of the compact 20, cooperates with the edges 28 and 32 to prevent bleach leakage from the other side of the compact 20.

In the compact 20, the end defined by edge structure 29 and 33 constitutes its hair receiving end. These edges are curved, having the concave curvature shown in FIGS. 1, 2 and 5, to conform to the curvature of a person's scalp so as to permit placement of the hair receiving end against the scalp and bleaching of the hair 11 down to the roots.

The outside surface of the case structure of the compact 20 is defined as two major surfaces and four edge portions. The first major surface is defined by the bottom wall of the well 25 and is curved and shaped, having the concave curvature shown in FIGS. 1, 3 and 4, to lie against a person's head or against another compact 20, as shown in FIG. 1.

The second major surface of the compact 20 is formed by the case half 22 and defines the cover for the well 25. The second major surface has substantially the same curvature as the first major surface so that one may rest against the other as shown in FIG. 1, and the first and second major surfaces are disposed in a substantially mutually parallel disposition.

The four edge portions of the compact 20 are defined by the aforementioned edge structures 26–33.

In use of one of the hair bleaching compacts 20, all hair strands 11 on a selected area of the head may be placed therein with bleach applied or only selected hair strands 11 may be placed in the compact 20 and bleached, as desired. Further, the compact 20 may be used to bleach the entire length of a hair strand 11 by applying bleach 39 thereto and folding it up in the compact 20, or just a selected portion of the hair strand, equal to the length of the compact 20, may be bleached. Thus, by constructing the compact 20 of a selected short length short portions of individual hair strands can be bleached, such as only the newly grown hair adjacent the hair roots.

A suitable set of dimensions for the compacts 20 are as follows: a length of 2 to 4 inches; width of 1 to 2 inches; and a height of 0.25 inches. It is noted that by making the height dimension substantially less than the length and width dimensions one compact 20 will readily lie on top of another, as shown in FIG. 1, so as to permit the use of a number of hair bleaching compacts 20 on an individual's hair.

Thus, there has been provided an improved apparatus in the form of a hair bleaching compact suitable for use by hairdressers or coiffeurs for applying bleach to selected strands of a person's hair, selected portions of individual hair strands or entire areas of a person's head of hair.

While there has been described what it is considered to be the preferred embodiment of the present invention, various changes and modifications may be made therein without departing from the spirit and scope of the present invention, as defined by the claims.

I claim:

1. A hair bleaching compact, comprising:

case structure which may be selectively opened and closed, said case structure when closed defining a cavity of selected width, length and depth for holding hair with bleach applied thereto, said case structure defining a hair receiving end through which hair strands may extend into said closed cavity, said hair receiving end having a concave curvature which substantially conforms to the curvature of a person's scalp so that said hair receiving end may be fitted close against a person's scalp to bleach the hair strands down to their roots, said case structure being made of first and second substantially rigid portions which mate to define said cavity, said first case portion defining a well of selected depth into which hair may be placed while bleach is applied thereto, said well functioning to collect applied bleach to prevent same from falling during application onto a person's scalp, said second case portion defining a cover for said well, said case structure further including hinge means which hinge together said first and second case portions, the outside of said case structure being defined by two opposed major surfaces and four edge portions, the first one of said major surfaces being formed by the part of said first case portion defining the bottom of said well and having a concave curvature which is shaped to lie and fit closely against the side of a person's head, the second one of said major surfaces being formed by the part of said second case portion defining the cover for said well, the depth of said cavity defined by said case structure being substantially less than its width and length so that said case structure has a thin substantially flat form, said second major surface substantially conforming in curvature and shape to said first major surface, said first and second major surfaces being disposed in a substantially mutually parallel disposition so several of said hair bleaching compacts may be placed on a person's hair one lying upon the other against the side of the person's head, said four edge portions being defined by the remaining parts of said first and second case portions which mate to define the side walls of said well and cavity and the height of said hair bleaching compact, the first and third of said four edge portions being diametrically opposed and defining the length of said hair bleaching compact, the length of said hair bleaching compact being of a selected limited dimension so that said hair bleaching compact may be used to bleach only a limited length of a strand of hair, the second and fourth of said four edge portions being diametrically opposed and joining the ends of the first and third of said four edge portions to define the width of said hair bleaching compact, the second of said four edge portions defining said concave curved hair receiving end through which hair strands may extend into said closed cavity;

seal means associated with the edges of said case structure for sealing said cavity effectively closed when said case structure is closed to prevent the leakage of bleach therefrom, said hinge means being formed along the third of said four edge portions and said seal means formed along the third of said four edge portions being formed at least in part by said hinge means, said hinge means being a continuous flexible member extending along the length of said hair bleaching compact to hinge together said first and second substantially rigid case portions, said seal means being formed along the fourth of said four edge portions being formed at least in part by flaps carrying gripping surfaces which frictionally adhere to each other when pressed together and can be pulled apart; and latch means associated with said case structure for selectively latching said case structure closed with strands of a person's head of hair therein, said latch means being formed along the first of said four edge portions and said seal means formed along the first of said four edge portions being formed by said latch means, said latch means being mating lip and groove means.

* * * * *